US007861699B2

(12) United States Patent
Gowan et al.

(10) Patent No.: US 7,861,699 B2
(45) Date of Patent: Jan. 4, 2011

(54) BALL TOSSING APPARATUS AND METHOD

(75) Inventors: Carl W. Gowan, Tracy, CA (US); Guillermo A. Garza, Tracy, CA (US)

(73) Assignee: Garza and Gowan Sports Equipment, Tracy, CA (US)

( * ) Notice: Subject to any disclaimer, the term of this patent is extended or adjusted under 35 U.S.C. 154(b) by 1410 days.

(21) Appl. No.: 10/831,977

(22) Filed: Apr. 26, 2004

(65) Prior Publication Data

US 2004/0266562 A1 Dec. 30, 2004

Related U.S. Application Data

(63) Continuation-in-part of application No. 09/975,099, filed on Oct. 9, 2001, now abandoned.

(51) Int. Cl.

| | |
|---|---|
| ***A63B 65/12*** | (2006.01) |
| ***A63B 69/40*** | (2006.01) |
| ***F41F 7/00*** | (2006.01) |
| ***F41F 1/00*** | (2006.01) |
| ***F41B 7/08*** | (2006.01) |
| ***F41B 6/00*** | (2006.01) |
| ***F41A 23/00*** | (2006.01) |
| ***F41A 19/58*** | (2006.01) |

(52) U.S. Cl. ..... 124/32; 124/6; 124/7; 124/16; 124/29; 124/31; 124/34; 473/499; 473/422; 473/415; 473/451

(58) Field of Classification Search ..... 124/16, 124/3, 54, 19, 31–34, 7, 50, 6, 51.1, 78, 37, 124/56, 29; 473/451, 416–418, 422, 415, 473/499–501; 273/317, 317.1, 317.6, 317.7, 273/337, 399, 405; 434/247

See application file for complete search history.

(56) References Cited

U.S. PATENT DOCUMENTS 2,310,746 A * 2/1943 Parker et al. ..... 124/8

(Continued)

OTHER PUBLICATIONS

KSR v. Teleflex, 2007.*

*Primary Examiner*—Peter DungBa Vo
*Assistant Examiner*—Matthew D. Hoel
(74) *Attorney, Agent, or Firm*—Henneman & Associates, PLC; Larry E. Henneman, Jr.

(57) ABSTRACT

A ball tossing apparatus includes a support frame and a plurality of launch devices fixed to the support frame and arranged in a two-dimensional array. The launch devices include cylinders having a spring fixed therein, with a ball carrier fixed to the spring. The balls are retained in a loaded position (springs compressed) and then upon activation of the launch devices are launched vertically into the air to the sports player. In another embodiment, the launch devices include a rotating lever which is acted on by a biasing member to launch the ball vertically from the cylinder. A method for launching the balls includes the steps of loading the balls into a two dimensional array, and then launching the balls according to a launch sequence. An electronic control system for use with the ball tossing apparatus includes a launch module for launching the loaded balls in the plurality of launch devices according to a launch sequence. The launch sequences can be randomly generated, programmed by the sports player, or retrieved from memory. The launch of the balls can also be controlled remotely.

71 Claims, 13 Drawing Sheets

U.S. PATENT DOCUMENTS 3,341,199 A * 9/1967 Madsen ..... 473/499
3,856,300 A * 12/1974 Payne ..... 124/16
4,445,685 A * 5/1984 Cardieri ..... 473/417
4,778,177 A * 10/1988 Taksony ..... 473/451
4,865,318 A * 9/1989 Lehmann et al. ..... 124/16
5,000,448 A * 3/1991 Anderson ..... 473/501
5,221,081 A * 6/1993 Rooks ..... 124/16
6,440,013 B1 * 8/2002 Brown ..... 473/422
6,856,300 B2 * 2/2005 McCarrick ..... 343/853
6,875,136 B2 * 4/2005 Leal et al. ..... 473/451
2003/0203773 A1 * 10/2003 Leal et al. ..... 473/418

* cited by examiner

BALL TOSSING APPARATUS AND METHOD

RELATED APPLICATIONS

This application is a continuation-in-part of U.S. patent application Ser. No. 09/975,099, filed Oct. 9, 2001 now abandoned by the same inventors, which is incorporated herein by reference in its entirety.

BACKGROUND OF THE INVENTION

1. Field of the Invention

The present invention relates generally to sports training devices, and more particularly to a ball tossing apparatus and method used to train a sports player to hit air-born objects. Even more, particularly the present invention is used to improve the batting skills of a baseball/softball player.

2. Description of the Background Art

The game of baseball has been an American favorite for well over a century. Developing the skills required to play the game of baseball takes time, and continuous training on the part of the player. Batting, a skill required to be a valuable baseball player, is often one of the most difficult to learn because of its complex nature. For example, a batter must repeatedly execute consistent setup and stride at the plate. Additionally, an experienced batter will be able to selectively hit to different field positions. Finally, the batter must develop excellent hand-eye coordination, so as to be able to hit a ball at many varied pitch locations.

Many devices have been presented in the prior art that provide batting practice by vertically tossing baseballs to a batter. These devices, however, require frequent reloading, and/or manual release of the baseball in a manner detrimental to proper skill development of the batter. For example, in U.S. Pat. No. 4,865,318, issued Sep. 12, 1989 to Lehmann et al., the batter must frequently reload the ball tossing device, and must depress a foot pedal to launch the ball, which could hinder consistent stride and stance development. Another example is U.S. Pat. No. 5,221,081, issued Jun. 22, 1993 to Rooks. Rooks discloses a batter training apparatus that randomly releases balls to the batter. According to Rooks a plurality of launchers are arranged linearly in relation to one another. This linear arrangement results in incomplete coverage of the strike zone. Another disadvantage of Rooks is that the release mechanism is such that two or more balls may be released simultaneously, thereby wasting valuable practice time.

Many prior art devices also have the disadvantage of focusing ball coverage only to areas in and directly around the conventional strike zone. The conventional strike zone is generally understood to be the area over home plate through which a pitched baseball must pass horizontally to be called a strike. Rooks, for example focuses on this area. However, it is sometimes desirable to hit pitches early (in front of home plate) or late (behind home plate) to "pull" balls to different sides of the field. For example, a right handed hitter can hit a ball to the left side of the field by hitting the ball early, and can hit a ball to the right side of the field by hitting the ball late. It is also sometimes desirable to hit an inside (batter side of home plate) or outside (side of home plate opposite the batter) pitch.

Devices which launch balls to a batter horizontally provide no control as to where along the horizontal path the balls are struck by the batter. In vertical launch pitching machines, such as described by Rooks, the position of the launch device determines the point of contact in the horizontal plane. However, the prior art, including Rooks, does not recognize the advantage of vertically launching baseballs in front of the plate, behind the plate, or outside of the strike zone.

What is needed is a ball tossing apparatus that releases balls in a variety of locations, both inside and outside the strike zone, in a controlled manner, without disrupting the action of the hitter. What is also needed is a baseball training apparatus that is convenient to use and transport.

SUMMARY

The present invention overcomes the problems associated with the prior art by providing a novel ball tossing apparatus and method that sequentially launches a plurality of balls to a sports player. The balls are launched vertically, according to a launch sequence, from a plurality of launch devices that are arranged in a two-dimensional array.

In a particular embodiment of the present invention, a ball tossing apparatus includes a support frame and a plurality of launch devices that are fixed to the support frame and arranged in a two-dimensional array. Each launch device includes a biasing member for projecting a ball from the launch device, and a release device for retaining the biasing member in a loaded position, and for releasing the biasing member to project the ball. In a more particular embodiment, the launch device is a cylinder, the biasing member is a coil spring fixed within the cylinder, and the release device is a solenoid. A ball carrier is coupled to the coil spring, and includes at least one engaging structure for engaging the solenoid. Optionally, the carrier may include a conical interior surface for carrying balls of varying diameters.

In an alternate embodiment, a launch devices includes a lever having a first end rotatably coupled to the support frame and a second end adapted to engage the ball, and a biasing member (e.g., a coil spring) coupled between the lever and the support frame to cause the lever to rotate and project the ball upward off the second end of the lever. In this embodiment, the launch device includes a cylinder with a longitudinal section removed therefrom such that the lever can engage the ball through the cylinder wall. Optionally, the cylinder includes a lip to retain the ball above the support frame such that the lever can contact the ball from the underside. In addition, the support frame can include a top deck having a slot formed therein, such that when the lever rotates about its first end, the lever can pass through the top deck.

In a particular alternate embodiment, the support frame includes a base, and the launch device includes a mount coupled to the base to support the launch device away from the base. The launch device includes a rotatable shaft coupled to the mount, and the lever is coupled at its first end to the rotatable shaft. The shaft also includes a rotor at one end having a biasing member receiver for engaging the biasing member, and a lever arm disposed to engage the lever. A ratchet gear disposed between the shaft and the rotor allows the rotor to be driven by the shaft or to rotate independently thereof, depending on the direction of rotation. The biasing member receiver and lever arm are spaced apart from one another and are positioned on opposite sides of the rotor such that the biasing member can act between the receiver and the support frame, and the lever arm can act on the lever. The launch device also includes a motor that drives and end of the shaft opposite the rotor in order to turn the rotor. The lever is disposed between the motor and the rotor. Optionally, a lever position retainer (e.g., a second rotor) can be fixed to the shaft between the lever and the motor to retain the lever in proper position.

In one particular embodiment, the support frame is rectangular, and has a base, sides, and a top deck, with the plurality of launch devices being disposed below the top deck. Optionally, a portion of the interior of the support frame may be used for ball storage. An optional handle, coupled to the support frame, facilitates transportation of the ball tossing apparatus. In a more particular embodiment, the support frame includes indicia of a home plate that is optionally adjustable in position.

In the disclosed embodiment the ball tossing apparatus includes an electronic control system. The control system includes a processing unit for executing data and code, and memory for storing the data and code. The code includes a launch module for sequentially activating the plurality of launch devices.

An optional user interface facilitates user interaction with the electronic control system Examples of user input devices include, but are not limited to, a keypad, a remote control, selector switches, etc. Examples of user feedback devices include, but are not limited to, a speaker, a display device, etc.

In certain embodiments with a user interface, the launch module, responsive to instructions from the user is operative to execute a predetermined launch sequence. For example, the user interface enables the user to input and store a launch sequence. As another example, the user interface enables the user to select a randomly generated launch sequence. As yet another example, the user can select a launch sequence from a plurality of predefined launch sequences via the user interface.

In a more particular embodiment, the launch module, responsive to a launch instruction received from the user is operative to activate a single one of the launch devices. For example, in one embodiment, the launch module is operative to activate the next one of the launch devices, responsive to each launch instruction, according to a predetermined launch sequence. As another example, the launch module, responsive to each subsequently received launch instruction, is operative to activate a next one of the launch devices depending on a value of the received launch instruction.

In a particular embodiment, the remote control provides launch instructions from the user to the electronic control system. For example, the remote control may include a pattern of buttons corresponding to the layout of the launch devices. When one of the buttons on the remote control is depressed, launch instructions are sent to the electronic control system to activate the corresponding launch device. As another example, the remote control can also include other input devices such as a numeric keypad, selector buttons, etc.

In an alternate embodiment, the ball tossing apparatus does not include a user interface, and the launch module activates the plurality of launch devices according to a randomly generated launch sequence, or according to a predefined launch sequence.

A particular method of the present invention includes the steps of loading a plurality of balls into a corresponding plurality of launch devices arranged in a two dimensional array, and launching the plurality of balls according to a launch sequence. Balls are loaded in one of a plurality of loaded positions depending on the desired launch height.

In one particular method, the step of launching the balls includes selecting a launch sequence. Selecting the launch sequence may include one or more of receiving a launch sequence from the user, generating a random launch sequence, or retrieving a predefined launch sequence from memory. Optionally, a sequence received from the user can be stored to memory as a predefined sequence for later retrieval.

DETAILED DESCRIPTION

The present invention overcomes the problems associated with the prior art, by providing a novel system and method for launching balls to a sports player. In the following description, numerous specific details are set forth (e.g. remote controlled ball launch, a ball storage compartment, solenoid release mechanisms, etc.) in order to provide a thorough understanding of the invention. Those skilled in the art will recognize, however, that the invention may be practiced apart from these specific details. In other instances, details of well-known practices (e.g. software programming, mechanical construction, electrical wiring, etc.) have been omitted, so as not to unnecessarily obscure the present invention.

Figure 1:
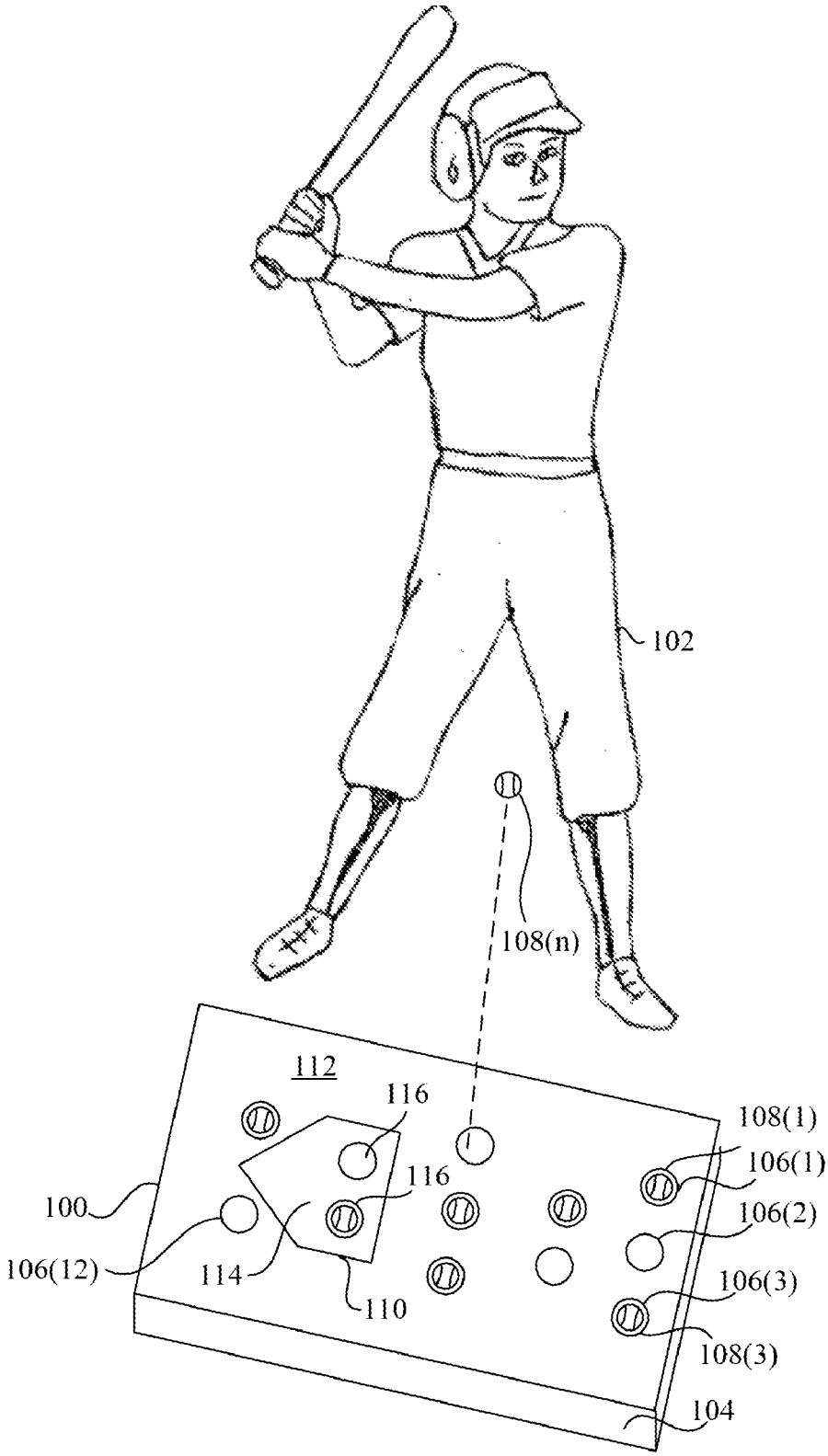
FIG. 1 shows a baseball player using one embodiment of a ball tossing apparatus of the present invention for batting practice.

FIG. 1 shows a ball tossing apparatus 100 used to provide batting practice to a batter 102. Ball tossing apparatus 100 includes a support frame 104 that rigidly encases a plurality of launch devices 106(1-n). In the depicted embodiment, launch devices 106(1-n) are disposed substantially vertically within support frame 104. Several of launch devices 106(1-n) (e.g. launch device 106(1)) are shown loaded with baseballs 108 (1-n) ready to be launched. Launch devices 106(1-n) are distributed throughout support frame 104 in a two-dimensional array, to cover many areas of the strike zone of batter 102. Baseball 108(n) is shown to have been launched vertically. Launch devices 106(1-n) that are empty are presumed to have already launched their respective baseballs 108(1-n), or optionally were not loaded by batter 102.

Arranging launch devices 106(1-n) in a two-dimensional array provides many advantages over the prior art. For example, baseballs 108(1-n) are launched into the air in a variety of pitch locations (e.g. outside, inside, high, and low) that realistically simulate live game-play. Additionally, baseballs 108(1-n) that are launched in front of or behind batter 102 teach him/her to hit a pitch early (forward launch) and late (behind launch). By hitting pitches in a variety of locations, batter 102 will learn consistent setup and stride, to hit to any position on the field, patience at the plate while batting, and an overall awareness of their individual strike zone. As yet another example, ball tossing apparatus 100, because of it's large two-dimensional array of launch devices 106(1-n), requires infrequent reloading.

Ball tossing apparatus 100 further includes relational indicia 110 located on a top deck 112 of ball tossing apparatus 100. In the depicted embodiment, indicia 110 is a home plate 114 with two apertures 116 formed therein to facilitate the launch of two of baseballs 108(1-n) through home plate 114. In this particular embodiment, home plate 114 can be placed at any position on top deck 112 so long as home plate 114 does not cover loaded ones of launch devices 106(1-n). Optionally, indicia 110 can be painted on top deck 112. In yet another alternate embodiment, indicia 110 is embodied in a wire frame to minimize interference with launch devices 106(1-n).

Disposing launch devices 106(1-n) below top deck 112 provides a variety of advantages. For example, top deck 112 provides a protective barrier against dirt and debris. As another example, top deck 112 sturdies launch devices 106 (1-n) and prevents them from damage possibly caused by a misdirected swing of the baseball bat, or from being stepped on by a careless player. As yet another example, disposing launch devices 106(1-n) below top deck 112 creates a compact, aesthetically pleasing appearance of ball tossing apparatus 100.

It should be noted that baseball is not the only sport that would benefit from the instant invention. For example softball or cricket players could utilize ball tossing apparatus 100 for batting practice just as easily as baseball players. Additionally, tennis players learning serving techniques or ball return techniques would also benefit from the present invention. For purposes of clarity and consistency, however, the instant invention will continue to be described with respect only to baseball.

Figure 2:
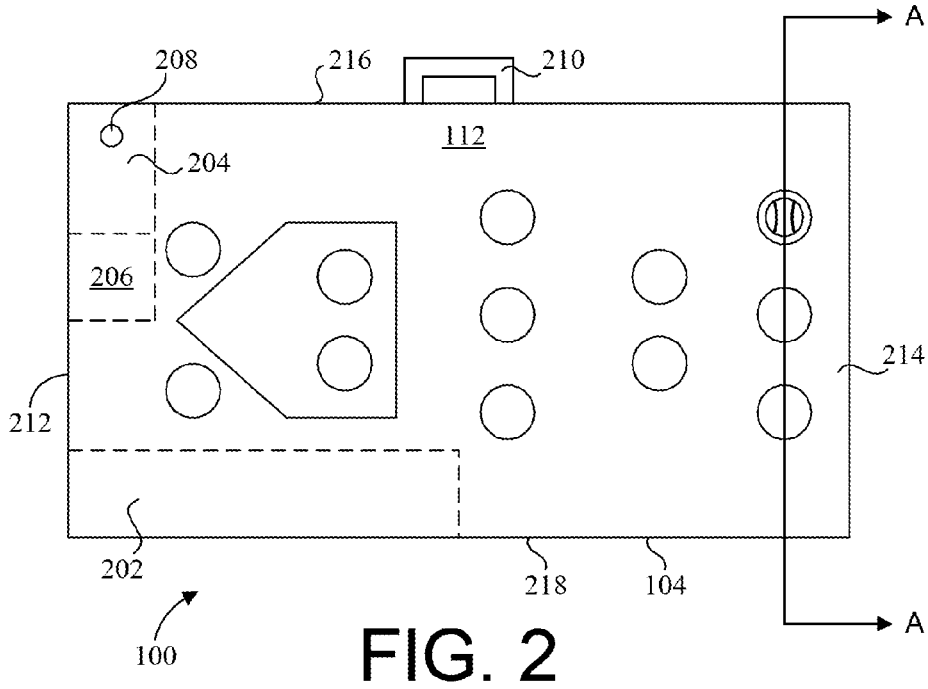
FIG. 2 shows a top view of the ball tossing apparatus of FIG. 1.

FIG. 2 shows a top view of ball tossing apparatus 100. Ball tossing apparatus 100 is shown representationally to further include a ball storage compartment 202, an electronic control system 204, a power supply 206, a start switch 208, and a handle 210. Support frame 104, in addition to top deck 112, includes a rear wall 212, a front wall 214, a left side wall 216, a right side wall 218, and a base not visible in the view of FIG. 2. Ball storage compartment 202 is formed in the interior space of support frame 104 and is designed to hold a supply of baseballs for use with ball tossing apparatus 100. An access door (not shown) formed in support frame 104 provides access to ball storage compartment 202. As shown in FIG. 2, ball storage compartment 202 is rectangular in shape, but it should be understood that other shapes (e.g. a cylindrical tube, etc.) could be used. Further, in an alternate embodiment, storage compartment 202 is embodied in a detachable tube that can be secured to the outside of support frame 104.

Electronic control system 204 controls and coordinates the launch of balls 108(1-n) from launch devices 106(1-n). A more detailed description of the operation of control system 204 will be provided hereinafter. Electronic control system 204 is powered by power supply 206. Power supply 206 includes one or more standard disposable batteries or a rechargeable battery pack. Those skilled in the art will realize that power supply 206 may be replaced and/or augmented with an adapter capable of receiving and converting power from an alternate power supply.

Start switch 208 provides an initiate signal to electronic control system 204 to commence the launch of baseballs 108(1-n). Start switch 208 is located to facilitate easy activation by a user. For example, batter 102 could simply depress start switch 208 with his foot or the end of his baseball bat. After a short delay to allow the batter to set up, electronic control system 204 sequentially provides launch signals to launch devices 106(1-n) to launch baseballs 108(1-n). A handle 210 is also fixed to support frame 104 to facilitate easy transportation of ball tossing apparatus 100.

It should be noted that although ball tossing apparatus 100 is shown to be portable, ball tossing apparatus 100 may also be fixed or manufactured into a permanent structure such as in the floor of a batting cage, in place of home plate in a little league baseball or softball field, or in a portion of a sports stadium to provide batting practice or warm up hitting. Those skilled in the art will realize that if ball tossing apparatus 100 is implemented in a permanent structure certain components could be omitted (e.g. handle 210) or replaced (e.g. hard wiring instead of power supply 206, etc.).

Figure 3:
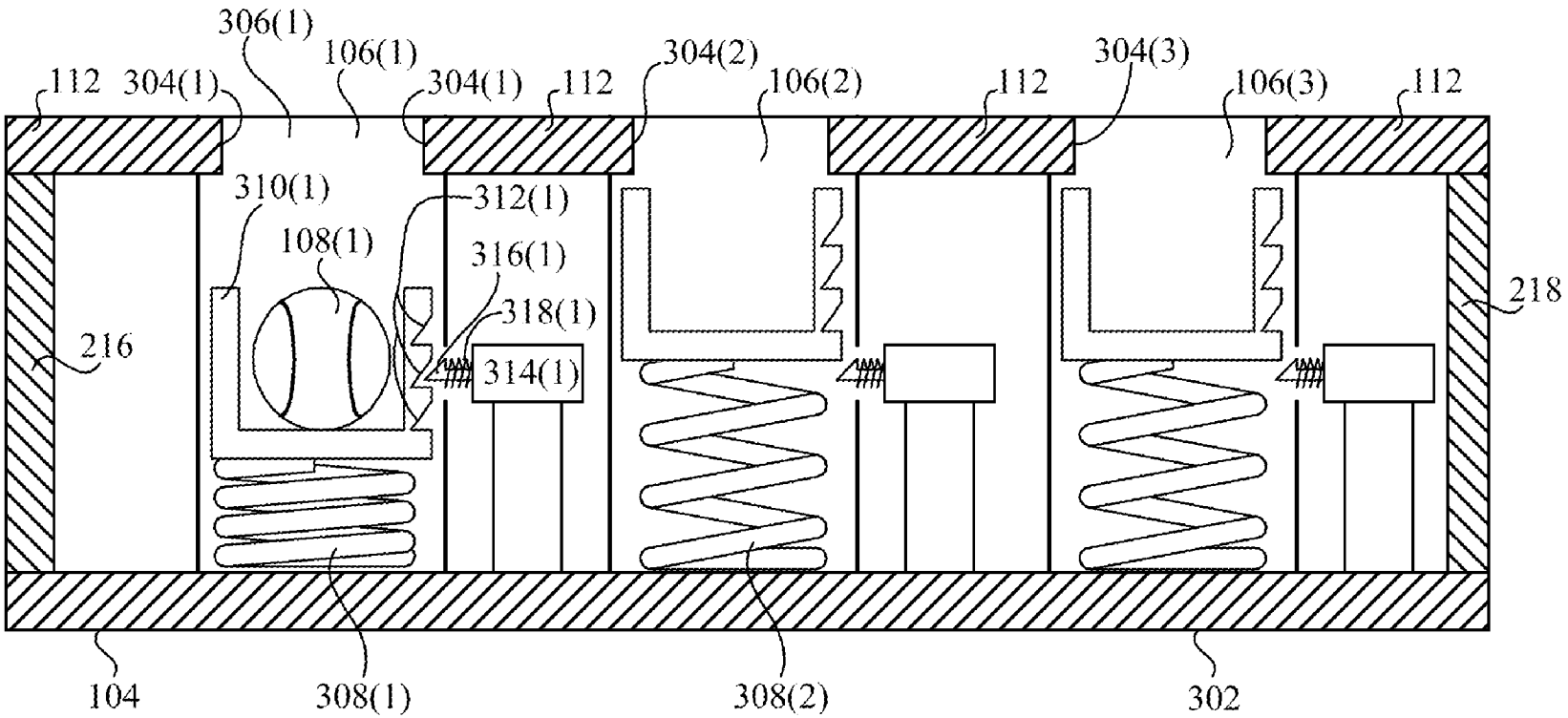
FIG. 3 is a cross-sectional view of the ball tossing apparatus of FIG. 2 taken along section line A-A.

FIG. 3 shows a cross-sectional view of ball tossing apparatus 100 taken along section line A-A of FIG. 2. Support frame 104 is now further shown to include a base 302, and top deck 112 is shown to include shoulder stops 304(1-n). Base 302, left side wall 216, right side wall 218, rear wall 212, front wall 214, and top deck 112 are fabricated from a sturdy, light-weight material such as fiberglass reinforced resin board, plastic, or other material. Launch devices 106(1-n) (106(1-3) shown) are fixed to and encased by support frame 104. Launch devices 106(1-n) can be fixed to the support frame in any number of ways (e.g. adhesive, fasteners, etc.) or can be integrally formed in top deck 112. It should be understood, however, that it is not essential that launch devices 106(1-n) be fixed within support frame 104, and can, in fact, be situated outside of or protrude from support frame 104.

Each of launch devices 106(1-n) comprises a cylinder 306 (1-n), a biasing member 308(1-n), a carrier 310(1-n), and a release device 314(1-n), respectively. In the depicted embodiment biasing member 308(1-n) comprises a large diameter (but small enough to travel within cylinders 306(1-n)) coil spring. However, it should be understood that alternate biasing means including, but not limited to elastic bands, stretched springs, compressed air, etc. can be used to provide baseballs 108(1-n) with enough kinetic energy to obtain a satisfactory launch height. Biasing member 308 is coupled to carrier 310 (e.g. via fasteners, adhesive, welding, etc.). Carrier 310(1) is guided by and travels within cylinder 306(1), and carries baseball 108(1) as it is accelerated upwardly. Carrier 310(1) is stopped by shoulder stop 304(1) and baseball 108(1) is launched from launch device 106(1). In this embodiment, shoulder stops 304(1-n) are provided by making the openings in top deck 112 smaller than the carriers 310(1-n). Cylinders 306(1-n) and carriers 310(1-n) are made of a PVC plastic or other strong, lightweight material. In the embodiment shown carriers 310(1-n) are formed as a cup-shaped piece of PVC plastic. However, carrier 310(1) can optionally be formed in other shapes including, but not limited to a circular flat plate, a convex plate, a concave plate, or other such structure that provides similar functionality.

Carrier 310(1) further includes a plurality of engaging structures 312(1) that are engaged by release device 314(1) when carrier 310(1) is pressed down into cylinder 306(1) during loading. Release device 314(1) engages one of engaging structures 312(1) thereby retaining biasing member 308 (1) in a compressed position, and disengages engaging structure 312(1) to allow biasing member 308(1) to project ball 108(1) out of launch device 106(1). In this example embodiment, release device 314(1) includes a solenoid, controlled by electronic control system 204, with engaging member 316(1), and a return spring 318(1). Responsive to a launch signal from control system 204, the solenoid retracts engaging member 316(1) to release biasing member 308(1). Return spring 318 (1) returns engaging member 316(1) to an engaging position when the solenoid is deactivated.

The use of multiple engaging structures 312(1) facilitates multiple loaded positions having varying amounts of spring compression, thus providing various launch heights of baseball 108(1). The height ball 108(1) attains depends on which of engaging structures 312(1) is engaged by release device 314(1). A desired launch height is selected by batter 102 when loading ball tossing apparatus 100. Varying launch heights ensure that the entire vertical strike zone is covered and batters of varying heights will be able to hit baseball 108(1). Each of the other launch devices 106(2-n) operate in substantially the same manner.

Launch devices 106(1-n) are shown to launch baseballs 108(1-n) vertically. In an alternate embodiment, one or more of launch devices 106(1-n) may be tilted slightly off the vertical axis in order to simulate a curve ball or other breaking pitch.

Figure 4:
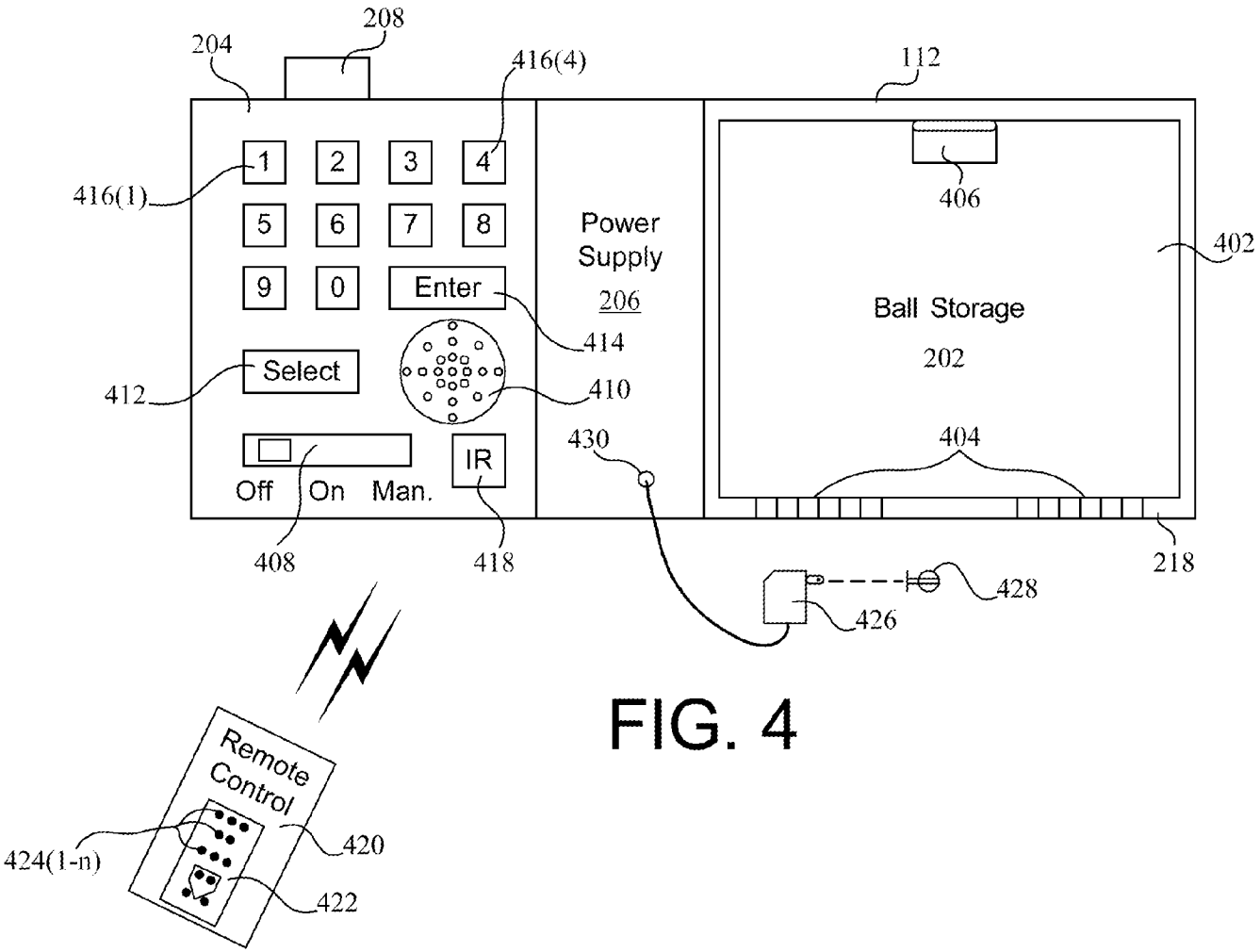
FIG. 4 shows a rear wall view of the ball tossing apparatus of FIG. 1.

FIG. 4 shows rear wall 212 of support frame 104 showing ball storage compartment 202, electronic control system 204, and power supply 206 in greater detail. Ball storage compartment 202 includes an access door 402, hinges 404, and a latch 406. Access door 402 provides access to ball storage compartment 202, and is coupled to base 218 by hinges 404. Latch 406 is adapted to engage top deck 112 to retain access door in a closed position. Optionally latch 406 includes a keyed lock to prevent theft of any balls stored within ball storage compartment 202.

Electronic control system 204 is also shown to include a plurality of user interface devices that include a power switch 408, a speaker 410, a select key 412, an enter key 414, and numeric keys 416(0-9). Power switch 408 allows a user to select one of two modes of operation, by sliding switch 408 from the "off" position to either the "on" or "manual" position. Speaker 410 provides audible feedback from electronic control system 204 to batter 102. For example, when electronic control system 204 is powered, speaker 410 would issue a sound (e.g. a particular tone, synthesized speech, etc.) to indicate to batter 102 that electronic control system is ready to function. As another example, control system 204 can issue audible tones via speaker 410 to acknowledge receipt of keypad entries. Optionally, a display (e.g. an LED display) can be included among the interface devices to provide additional feedback from control system.

Select key 412 is used by batter 102 to cycle through available launch modes (e.g. random launch, user programmed launch, predefined launch, etc.) when power switch 408 is in the "on" position. When cycling through each available launch mode, speaker 410 would issue an associated audible signal to indicate that a particular launch mode is selected. Batter 102 can then select a desired launch mode by depressing enter key 414. Enter key 414 serves as a general execution key for electronic control system 204. Batter 102 can use enter key 414 to perform such functions as accepting a launch mode, issuing commands to electronic control system 204, selecting a predetermined launch sequence, etc. Numeric keys 416(0-9) are used by batter 102 to input launch data into electronic control system 204. Launch data includes, but is not limited to launch sequences, predefined launch sequence identifiers, particular launch device identifiers, etc.

Electronic control system 204 further includes an infrared port 418 and a remote control 420. Infrared port 418 receives infrared signals from remote control 420. Remote control 420 facilitates remote operation of electronic control system 204, for example by a coach. All of the user input interfaces of electronic control system 204 may optionally be incorporated into remote control 420 as desired.

Remote control 420 further includes a ball launch schematic 422 having associated launch buttons 424(1-n) for each of respective launch devices 106(1-n). Ball launch schematic 422 can be used to program a launch sequence by depressing launch buttons 424(1-n) in the desired sequence. Additionally, when electronic control system 204 is operating in manual mode (i.e. when power switch 408 is in the "Man." position) each of baseballs 108(1-n) can be launched individually when electronic control system 204 receives an associated launch signal from remote control 420. Additionally, a baseball 108(n) could be launched by the remote controller (e.g. the coach of batter 102) simply by depressing the associated launch button 424(n) on remote control 420. This feature would allow a baseball coach to simulate the selective pitch placement batters face when at bat against a pitcher.

An optional protective cover (not shown) protects the input/output interfaces of control system 204 from accidental damage, dust, and debris. In the present embodiment, the protective cover would be transparent to permit transmission of infrared signals through the protective cover so that the infrared signals can be received by infrared port 418.

The user input/output interfaces shown in this particular embodiment are by way of example only. No particular user interface is considered to be an essential element of the present invention. Rather, various user interfaces may be employed depending on the particular desired functionality of control system 204.

Start button 208 is also shown in this view to be depressible by batter 102 using either his foot or his bat. Start button 208 begins the launch sequence in either the computer controlled or manual operation mode. Optionally, electronic control system 204 will only launch a subsequent one of balls 108(1-n) each time start button 208 is depressed.

Power supply 206 is shown to further include an AC adapter 426. AC adapter 426 provides power to power supply 206 by engaging a conventional wall outlet 428. AC adapter 426 is detachable from power supply 206 at adapter plug fitting 430 to ensure the portability of ball tossing apparatus 100. In an alternate embodiment, when ball tossing apparatus 100 is incorporated into a permanent structure (e.g. the floor of a batting cage, a little league field, etc.) power supply 206 can be eliminated and ball tossing apparatus 100 can be connected to a permanent power supply existing in the structure.

Figure 5:
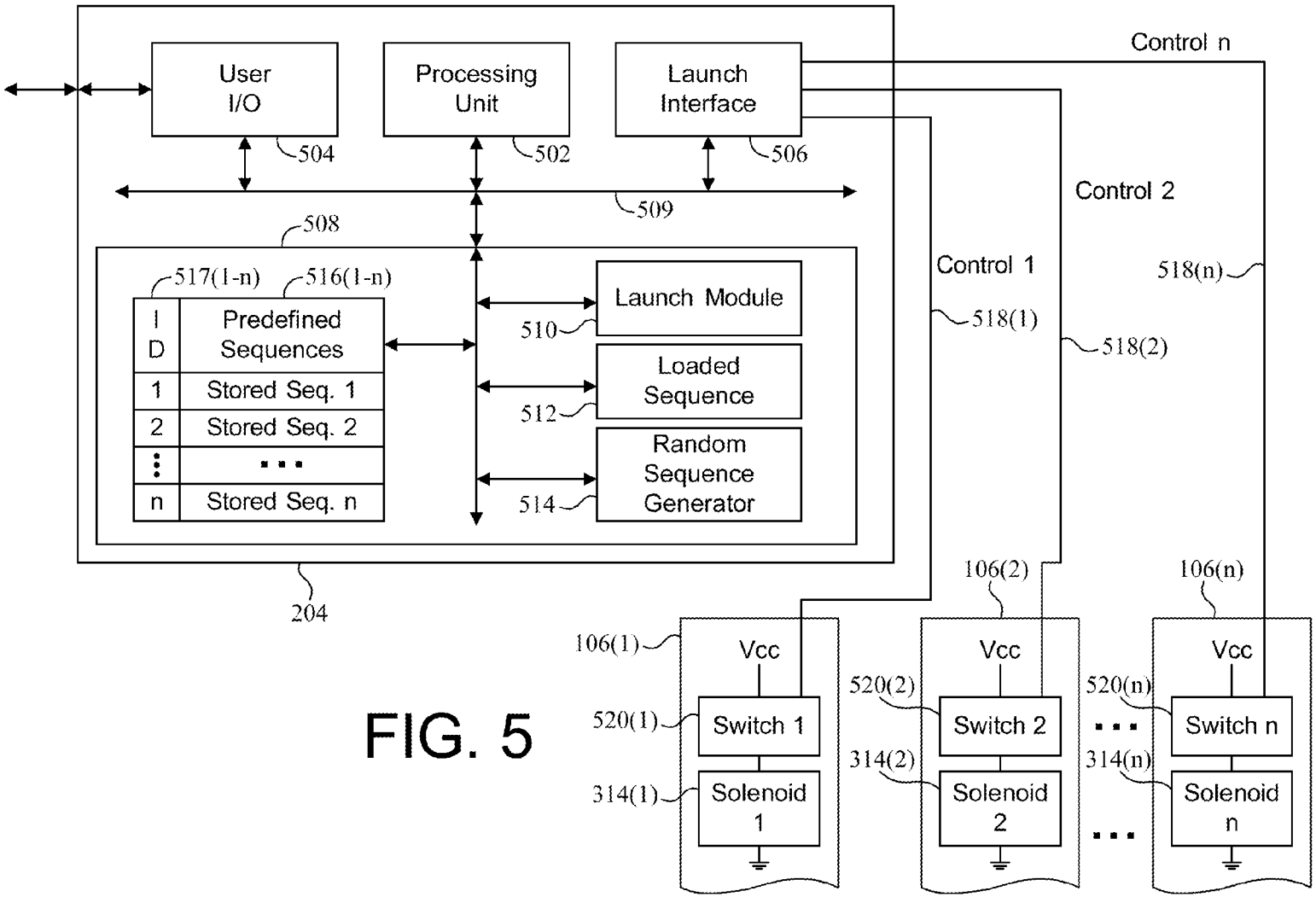
FIG. 5 shows a block diagram of an electronic control system for use in the present invention.

FIG. 5 shows a block diagram of electronic control system 204. Electronic control system 204 includes a processing unit 502, a user interface 504, a launch interface 506, and a memory device 508, all interconnected via system bus 509. Memory 508 stores data and code for execution by processing unit 502. Processing unit 502 processes and executes the data and code stored in memory 508 to impart functionality to control system 204. User I/O 504 represents the interface devices shown in FIG. 4 and/or any other user interfaces (e.g. an LED display) that may be necessary or desirable for use with a particular embodiment of the present invention. Launch interface 506 transmits launch signals, under the control of processing unit 502, to the appropriate launch devices 106(1-n) at the appropriate times.

Memory 508 is shown in this example as a single block. It should be understood, however, that memory 508 may include one or more types of memory. For example, working memory (e.g. SRAM, SDRAM, etc.) allows processing unit 502 to store and manipulate data and code during operation. Non-volatile memory (e.g. ROM, PROM. EPROM, etc.) stores and retains data and/or code even when control system 204 is powered down. Code stored in such non-volatile memory can be executed directly, or transferred to working memory when control system 204 is turned on. Further, other types of non-volatile data storage may be used, including, but not limited to hard disks, floppy disks, optical disks, or any other computer readable media. For the foregoing reasons, memory 508 is understood to include any hardware, software, firmware, or any combination thereof capable of providing the memory functions necessary to support any particular embodiment of the present invention.

Memory 508 includes a launch module 510, a loaded sequence 512, a random sequence generator 514, and a plurality of predefined sequences 516 (1-n). Launch module 510 provides overall control and coordination of the operations taking place within electronic control system 204. Loaded sequence 512 is a block of memory used to store the active launch sequence to be executed by launch module 510. When electronic control system 204 is powered up, loaded sequence 512 is initially empty, but can optionally be loaded with a default sequence at startup. Random sequence generator 514 is operative to generate random launch sequences. Predefined sequences 516(1-n) include stored release sequences that have been programmed at the time of manufacture and/or sequences that have been defined by a user (e.g. batter 102) and stored. Predefined sequences 516(1-n) are selected by batter 102 using sequence identifiers 517(1-n). In the present embodiment, each of sequence identifiers 517(1-n) is a single number that uniquely identifies an associated one of predefined sequences 516(1-n). Batter 102 can select any one of predefined sequences 516(1-n) by entering the associated sequence identifier 517(1-n) via numeric keys 416 (0-9), or, optionally, by stepping through the list of sequences.

Launch module 510 carries out the operative functions of electronic control system 204 when activated by batter 102 or another user. In one mode of operation, launch module 510 retrieves a selected one of launch sequences 516(1-n), loads the retrieved launch sequence into loaded sequence 512, and sequentially transmits launch signals, via launch interface 506, to launch devices 106(1-n) according to loaded sequence 512. In another mode of operation, responsive to instructions from batter 102, launch module 510 instructs random sequence generator 514 to generate a random launch sequence, loads the random sequence into loaded sequence 512, and transmits sequential launch signals according to the random launch sequence. Launch module 510 is further operative to retrieve a predefined launch sequence 516(1-n) and load it as loaded sequence 512. In yet another mode of operation, launch module 510 receives a launch sequence programmed from batter 102 via User I/O 504, and stores the entered sequence as another predefined sequence 516(n+1) for later use. In yet another mode of operation, launch module 510 transmits each successive launch signal in the sequence only upon receipt of launch instructions from batter 102 or another user (e.g. a coach, a friend, etc.), via user I/O 504.

Launch interface 506 transmits launch signals to launch devices 106(1-n) as follows. Responsive to receipt of a launch signal (e.g. an address corresponding to one of launch devices 106(1-n)) from launch module 510, launch interface 506 asserts an electrical signal on a corresponding one of a plurality of control lines 518(1-n). Each of control lines 518(1-n) is coupled to one of a plurality of switches 520(1-n). Each of switches 520(1-n) selectively couples with a respective one of solenoids 314(1-n) to a power supply and thereby energizes one of solenoids 314(1-n) responsive to the launch signal being asserted on the corresponding one of control lines 518 (1-n). The energized one of solenoids 314(1-n) launches the associated baseball 108 as described above with respect to FIG. 3.

A variety of switches are suitable for use as switches 520 (1-n). For example, switches 520(1-n) cap be simple power transistors. Alternately, switches 520(1-n) can be electromechanical switches.

Figure 6:
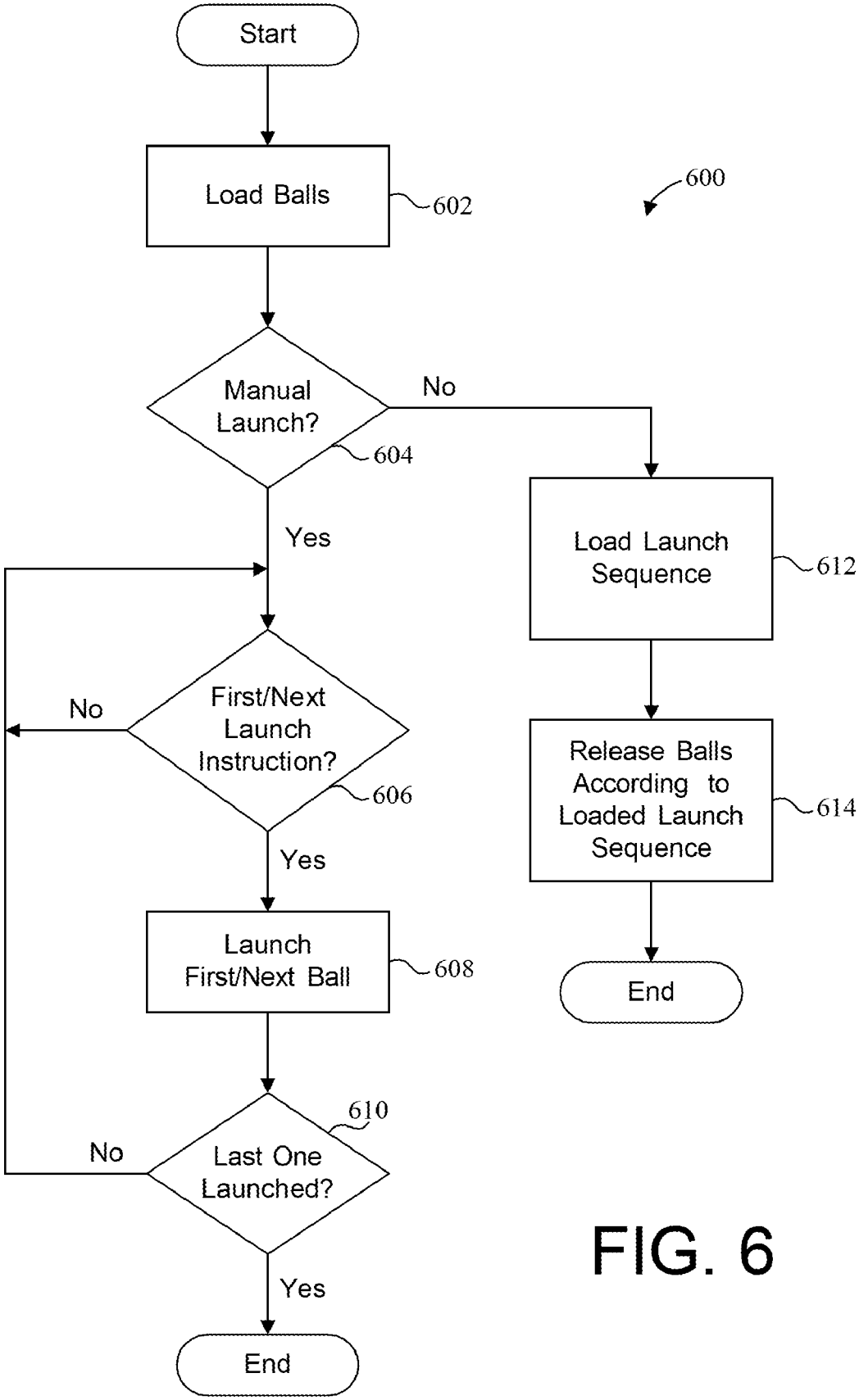
FIG. 6 is a flowchart showing one example method of sequentially launching balls according to the present invention.

FIG. 6 is a flowchart summarizing one method 600 of launching a plurality of baseballs 108(1-n), using ball tossing apparatus 100. In a first step 602 batter 102 loads launch devices 106(1-n) with baseballs 108(1-n) to their desired launch heights. Then in second step 604, if launch module 510, determines whether power switch 408 is to manual mode. If so, then in a third step 606 launch module 510 checks for the receipt of a first launch instruction from a user (e.g. batter 102, a coach, a friend, etc.) received via User I/O 504. If a launch instruction has been received, then in fourth step 608, launch module 510 transmits a launch signal, via interface 506, to launch the ball from a launch device 106(1-n) corresponding to the launch instruction. Then in a fifth step 610, launch module 510 determines if all of baseballs 108(1-n) have been launched. If all baseballs 108(1-n) have been launched then method 600 ends. Otherwise, method 600 returns to step 606 and waits for the next launch instruction. If in step 606, launch module 510 determines that no launch instruction has been received, then launch module 510 waits for a launch instruction to be received via User I/O 504.

If in second step 604, launch module 510 determines that Power switch 408 is not set to manual mode (i.e. is set to "on" position), then in a sixth step 612, launch module 510 loads a launch sequence into the loaded sequence 512 memory block. Next, in a seventh step 614, launch module 510 transmits launch signals via launch interface 506 to sequentially launch baseballs 108(1-n) according to loaded sequence 512. After all of baseballs 108(1-n) are launched, method 600 ends.

Figure 7:
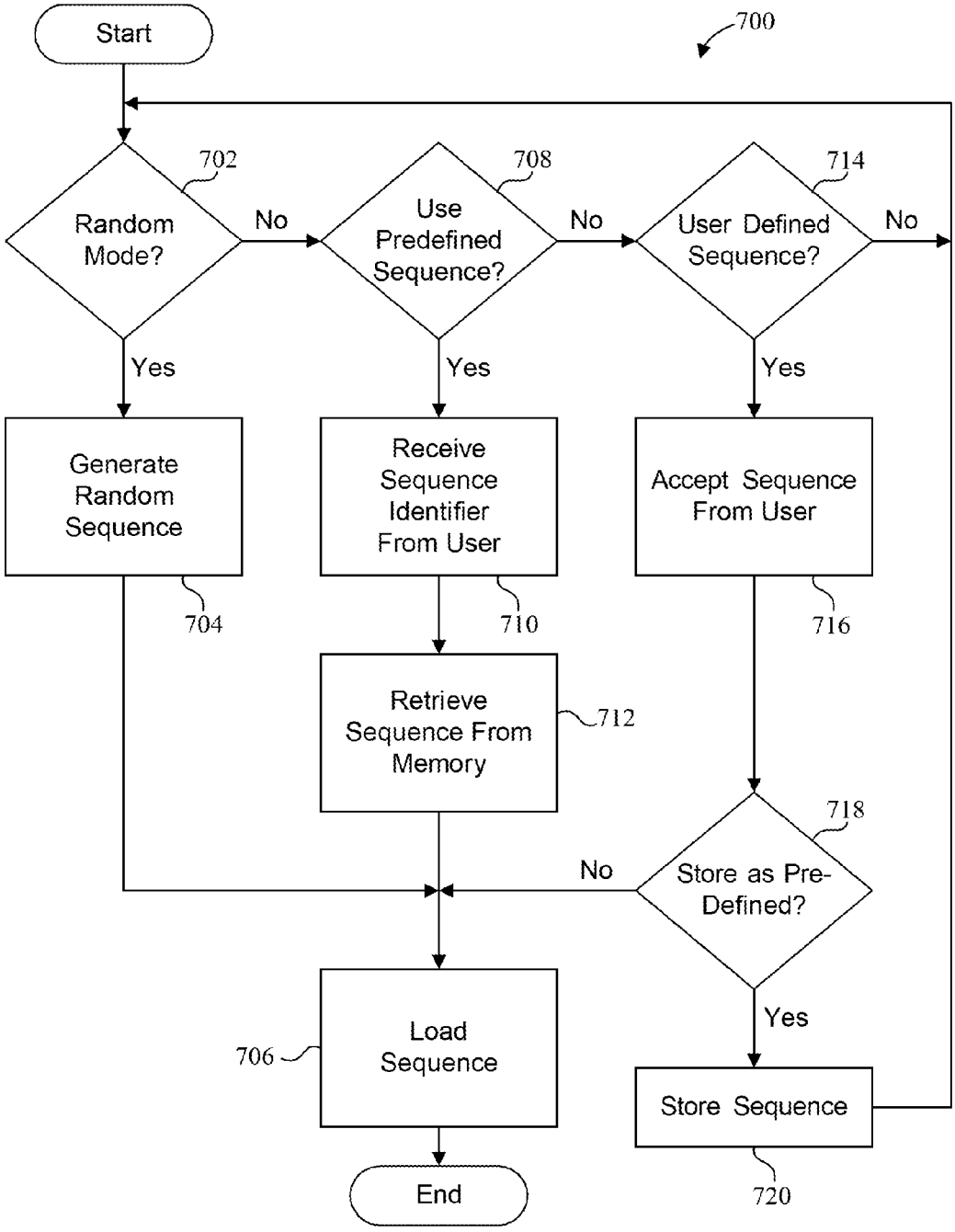
FIG. 7 is a flowchart showing one example method of performing the sixth step (load launch sequence) of the flowchart of FIG. 6.

FIG. 7 is a flowchart summarizing one method 700 of performing sixth step 612 (load launch sequence) of method 600. In a first step 702 launch module 510 determines whether batter 102 has indicated (via user I/O 504) that he/she wants baseballs 108(1-n) launched in a random order. If random mode is selected, then in a second step 704 random sequence generator 514 generates a random launch sequence. Then in a third step 706 launch module 510 loads the random launch sequence into loaded sequence 512 and method 700 ends.

If, in second step 702, launch module 510 determines that batter 102 does not want a random launch sequence, then in a fourth step 708 launch module 510 determines whether batter 102 wants to load one of predefined sequences 516(1-n). If so, then in a fifth step 710 launch module 510 receives a predefined sequence identifier from batter 102 via User I/O 504. Then, in a sixth step 712, launch module 510 retrieves one of predefined sequences 516(1-n) corresponding to the received identifier from memory 508. Then, method 700 proceeds to third step 706, and loads the retrieved predefined sequence 516(n) into loaded sequence 512 and method 700 ends.

If, in fourth step 708, launch module 510 determines that batter 102 does not want to load one of predefined launch sequences 516(1-n), then method 700 proceeds to a seventh step 714, where launch module 510 determines whether batter 102 wants to program their own launch sequence. If launch module 510 determines that batter 102 wants to program a launch sequence, then in an eighth step 716 launch module 510 receives the launch sequence from batter 102 via user I/O 504. Then in a ninth step 718, launch module 510 determines if batter 102 wants to store their programmed sequence as one of predefined sequence 516(n-1) for later retrieval. If batter 102 wants to store the programmed sequence, then in a tenth step 720 launch module 510 stores the programmed sequence as predefined sequences 516(n+1) so that it can be later recalled by batter 102, and method 700 returns to step 702. Otherwise, method 700 proceeds to step 706 and launch module 510 loads the programmed sequence into loaded sequence 512.

If in seventh step 714 launch module 510 determines that batter 102 does not want to define a sequence then method 700 returns to first step 702.

Figure 8:
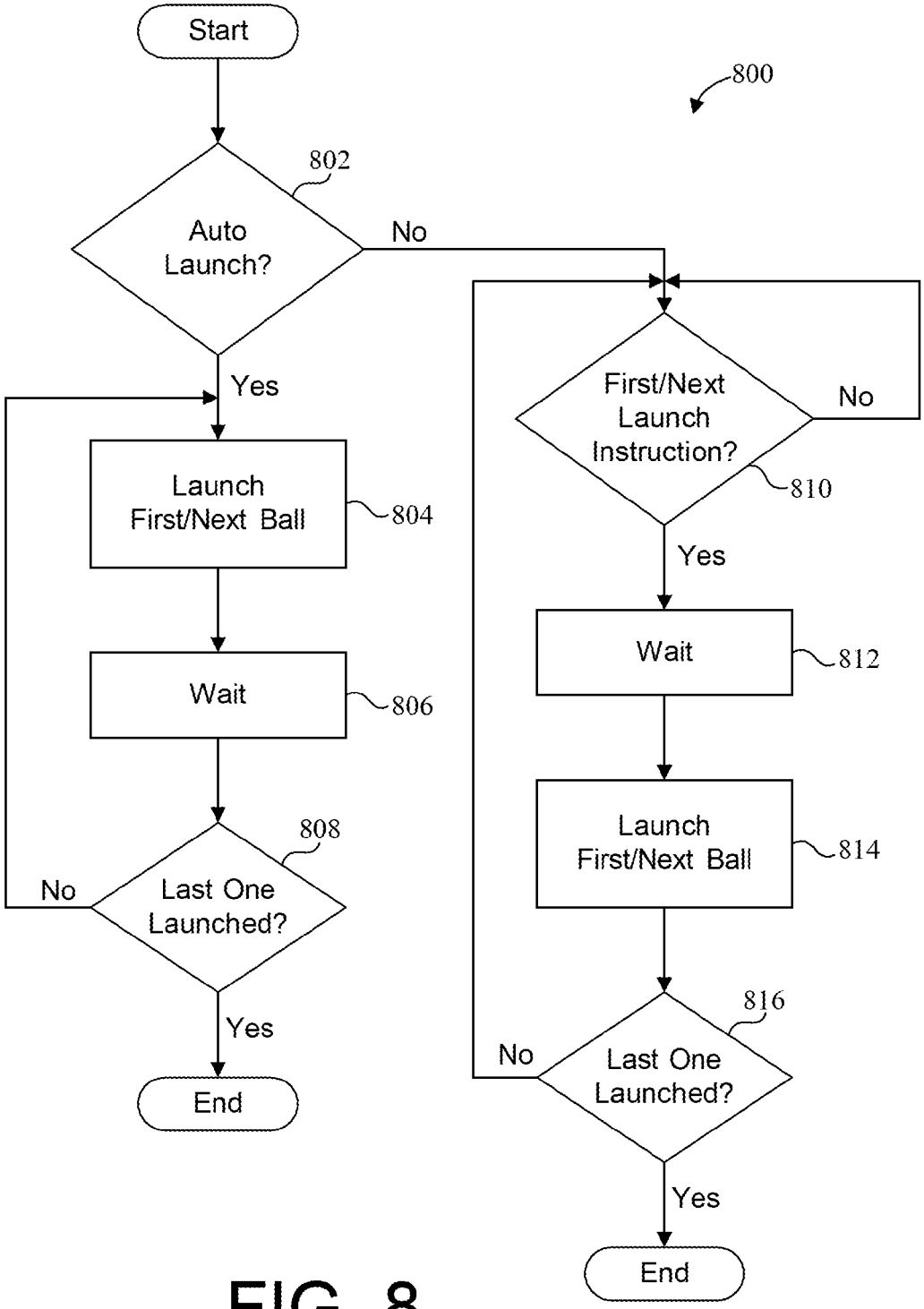
FIG. 8 is a flowchart showing one method of performing the seventh step (release balls) of the flowchart of FIG. 6.

FIG. 8 shows a flowchart summarizing one method 800 of performing the seventh step 614 (release balls) of method 600. In a first step 802, launch module 510 determines if batter 102 wants an automatic launch of baseballs 108(1-n). If batter 102 does want an automatic launch then in a second step 804, launch module 510 launches the first of baseballs 108(1-n) as indicated by loaded sequence 512. Then in a third step 806 launch module 510 waits a predetermined amount of time for the batter to reset himself and be ready for a subsequent ball launch. Next, in a fourth step 808, launch module 510 determines if the last of baseballs 108(1-n) was launched. If all of baseballs 108(1-n) have been launched then method 800 ends. Otherwise, method 800 returns to second step 804.

If in first step 802 launch module 510 determines that batter 102 does not want launch module 510 to automatically launch baseballs 108(1-n), then method 800 proceeds to a fifth step 810. In fifth step 810 launch module 510 waits to receive a launch instruction from batter 102, or another user (e.g. a coach) wishing to control the launch sequence. When launch module 510 receives a launch instruction then method 800 proceeds to a sixth step 812, where launch module 510 waits a predetermined time period, then in a seventh step 814 launch module 510 launches the first one of baseballs 108(1-n) in the loaded sequence 512. Then in eighth step 816 launch module determines if the last of baseballs 108(1-n) has been launched. If the last of baseballs 108(1-n) has been launched method 800 ends. Otherwise, method 800 returns to fifth step 810 to wait for an instruction to launch the next one of balls 108(1-n).

Figure 9:
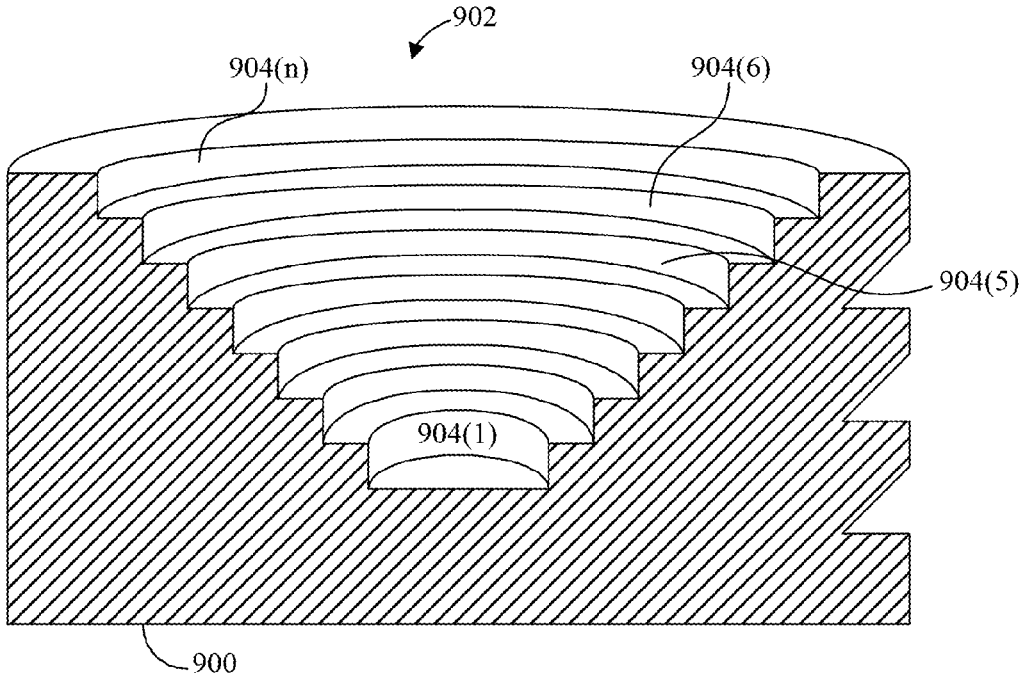
FIG. 9 shows an alternate ball carrier for use in the present invention.

FIG. 9 shows a cross-section of an alternate carrier 900 which can be substituted for carriers 310(1-n). Carrier 900 is modified from carriers 310(1-n) to include a graduated cup portion 902. Graduated cup portion 902 includes a series of concentric, stepped rings 904 (1-n) forming an inverted cone shape extending up and out from the bottom, center of cup portion 902. Graduated cup portion 902 permits carrier 900 to hold balls of varying diameter. For example, carrier 900 is capable of retaining balls from as small as a Ping-Pong ball to as large as a softball, whereas carriers 310(1-n) were designed to hold balls of a particular diameter. Additionally, stepped rings 904(1-n) prevent balls from wedging into graduated cup portion 902, which might happen if graduated cup portion 902 had a smooth side wall.

Figure 10:
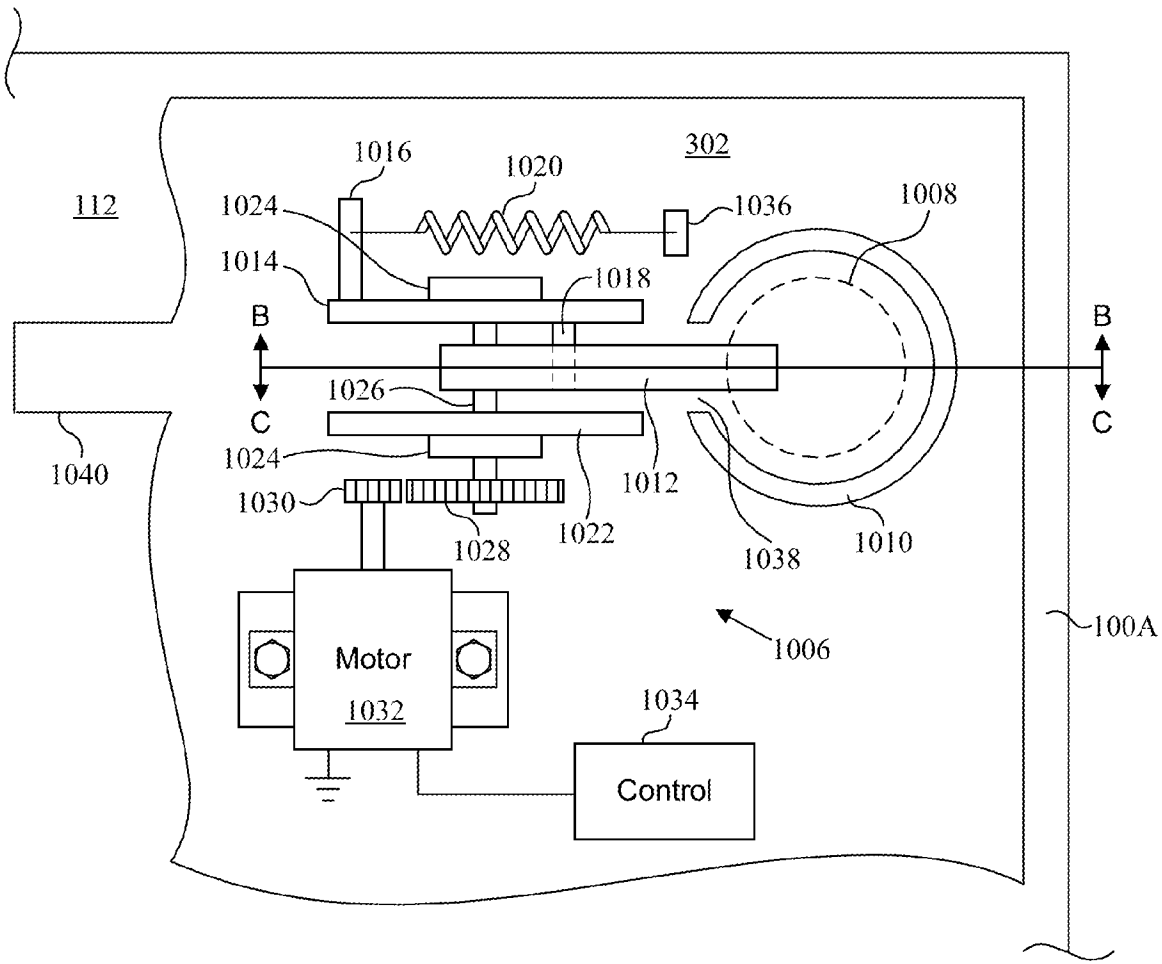
FIG. 10 is a partially cut-away view showing an alternate launch device of the present invention.

FIG. 10 shows a partially cut-away top view of an alternate ball tossing apparatus 100A with an alternate launch device 1006 according to the present invention. Ball tossing apparatus 100A is similar to ball tossing apparatus 100, except that launch device 1006 is substituted for original launch device 106(1). Launch device 1006 is also designed to launch a ball 1008 vertically into the air such that a batter can attempt to hit it. Launch device 1006 includes a launch cylinder 1010, a lever 1012, a first rotor 1014 having a biasing member receiver 1016 and a lever arm 1018, a biasing member 1020, a lever position retainer 1022, and a mount 1024. Lever 1012, rotor 1014, and lever position retainer 1022 are all coupled to mount 1024 via a common shaft 1026. A shaft drive gear 1028 is connected to one end of shaft 1028 and mates with a smaller, complementary motor gear 1030, which is driven by a motor 1032 controlled by a control system 1034.

The components of launch device 1006 function as follows. Cylinder 1010 retains ball 1008 and when launched, guides ball 1008 vertically into the air. Lever 1012 freely rotates around shaft 1026, and when acted upon by lever arm 1018 projects ball 1008 upward out of cylinder 1010 and into the air. First rotor 1014 is attached (e.g., welded, screwed, key-pinned, etc.) to shaft 1026 opposite motor 1032, and rotates with shaft 1026 when shaft 1026 is driven. Biasing member receiver 1016 is coupled (e.g., welded, screwed into, formed integrally, etc.) to rotor 1014, and receives an end of biasing member 1020, such that rotor 1014 is acted on by the varying force applied by biasing member 1020 as rotor 1014 rotates. Lever arm 1018 is positioned under lever 1012, and as rotor 1014 rotates, lever arm 1018 lifts lever 1012 in order to project ball 1008 vertically. Biasing member 1020 is attached between receiver 1016 and base 302 at a fastening point 1036 (or other portion of support frame 104), and facilitates rapid rotation of rotor 1014 through certain degrees of rotation. In the present embodiment, biasing member 1020 is a coil spring. Lever position retainer 1022 is also a rotor similar to rotor 1014 and retains lever 1012 in proper position (e.g., aligned with ball 1008). Note that the spacing between lever 1012 and rotors 1014 and 1022 is exaggerated to clearly show the respective components. Mount 1024 is a two piece mount and secures each end of shaft 1026 to base 302. Mount 1024 also supports shaft 1026 off of base 302 a sufficient distance so that lever 1012 can make a full rotation without striking base 302. Shaft 1026 drives rotors 1014 and 1022. Shaft gear 1028 is fixed to shaft 1026 and mates with motor gear 1030 such that it rotates when motor 1032 is energized. Motor 1032 drives motor gear 1030 responsive to a control signal (e.g., a launch signal) from control unit 1034. Control unit 1034 controls the launch process of launch device 1006. For example, responsive to a launch signal from a user and/or electronic control system 204, control unit 1034 energizes motor 1032 to launch ball 1008.

Launch device 1006 operates as follows. Initially, lever 1012 hangs straight down such that it is completely out of cylinder 1010. Then a ball 1008 is placed in cylinder 1010. Responsive to a launch instruction from control unit 1034, motor 1032 is energized and rotates motor gear 1030. Motor gear 1030 in turn drives shaft gear 1028 which causes shaft 1026 to rotate counter-clockwise (i.e., top of gear 1028 moves from right to left in FIG. 10). This in turn causes rotor 1014 to also rotate counter-clockwise, stretching spring 1020 and causing lever arm 1018 to engage the underside of lever 1012 such that lever 1012 moves toward ball 1008. At a particular time of rotation (e.g., when receiver 1016 is furthest from fastening point 1036), biasing member 1020 will exert a contraction force on receiver 1016, thereby rapidly spinning rotor 1014 such that arm 1018 forces lever 1012 into contact with ball 1008. Ball 1008 is thereby projected into the air. Once ball 1008 is launched, lever 1012 will spin freely around shaft 1026 and return to a hanging position, where it will remain until the next launch.

Some modifications are made to the ball tossing apparatus in order to accommodate launch device 1006. For example, a longitudinal section 1038 is removed from the side of cylinder 1010 so that lever 1012 can enter cylinder 1010. In addition, a recess 1040 (only a portion shown) is removed from top deck 112 such that lever 1012 can pass through top deck 112 as it rotates. Recess 1040 is not a necessary element for incorporating launch device 1006 into the ball tossing apparatus, however recess 1040 facilitates a lower top deck height and more compactness.

With respect to spring 1020, it should be noted that the force spring 1020 applies to rotor 1014 depends on the weight of ball 1008. For example, a plastic, hollow ball would require very little force to be projected into the air, and therefore a relatively light spring could be used. In contrast, a softball is heavier and would require more force, and thus a stronger spring, to launch it. In addition, the size of shaft gear 1028 can be readily modified such that low power motors can be used to turn shaft 1026. In the present embodiment, motor 1032 is a low voltage (e.g., 12V) motor, and each launch device 1006 includes its own motor 1032. However, it is possible to drive two or more launch devices with a single motor 1032 if the proper gearing is provided.

It should also be noted that control system 1034 is shown representationally only, and should be construed to encompass any control system capable of performing the launching functions and features (e.g., control system 204) described in the present invention. Indeed, all the functions performed by control system 204 can be readily incorporated into a ball tossing apparatus incorporating launch devices like launch device 1006.

Figure 11:
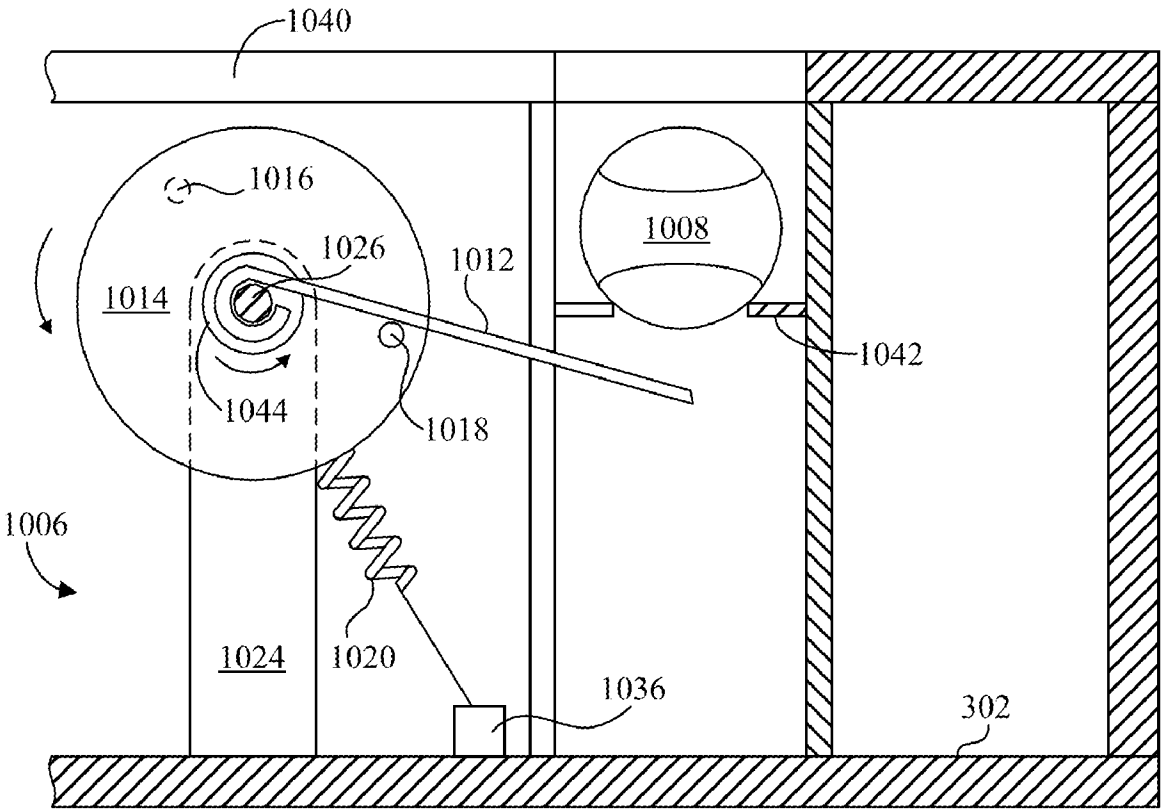
FIG. 11 is a cross-sectional view of the launch device of FIG. 10, taken along line B-B.

FIG. 11 is a cross-sectional view of a portion of launch device 1006 taken along section line B-B of FIG. 10, illustrating several features of launch device 1006. First, note that mount 1024 retains shaft 1026 (and the attached components) well above base 302. Most importantly, mount 1024 retains lever 1012 at an altitude such that lever 1012 does not catch on base 302. Second, ball 1008 is also retained well above base 302 by an interior lip 1042 formed circumferentially around the inside of cylinder 1010, except at removed section 1038 (FIG. 10). Lip 1042 retains ball 1008 high enough such that lever 1012 can easily travel under ball 1008. Finally, mount 1024 is shown to include a ratchet gear 1044 that facilitates driving rotor 1014 in a counter-clockwise direction by shaft 1026, but also allows rotor 1014 to spin freely in the same direction when acted upon by spring 1020.

In the present view, spring 1020 is shown at its maximum extension (apex of rotation), directly opposite fastening point 1036. As rotor 1014 rotates past its apex, spring 1020 will pull rotor 1014 rapidly around, because rotor 1014 is freely rotatable in the counter-clockwise direction. The force exerted by spring 1020 will be transferred to lever arm 1018 and to lever 1012, thereby projecting ball 1008 vertically into the air. It should be noted that receiver 1016 and lever arm 1018 are spaced apart such that as spring 1020 is at its maximum extension, lever arm 1018 is just coming into contact with lever 1012 such that most of the force exerted by spring 1020 as it contracts is directly transferred into lever 1012.

Figure 12:
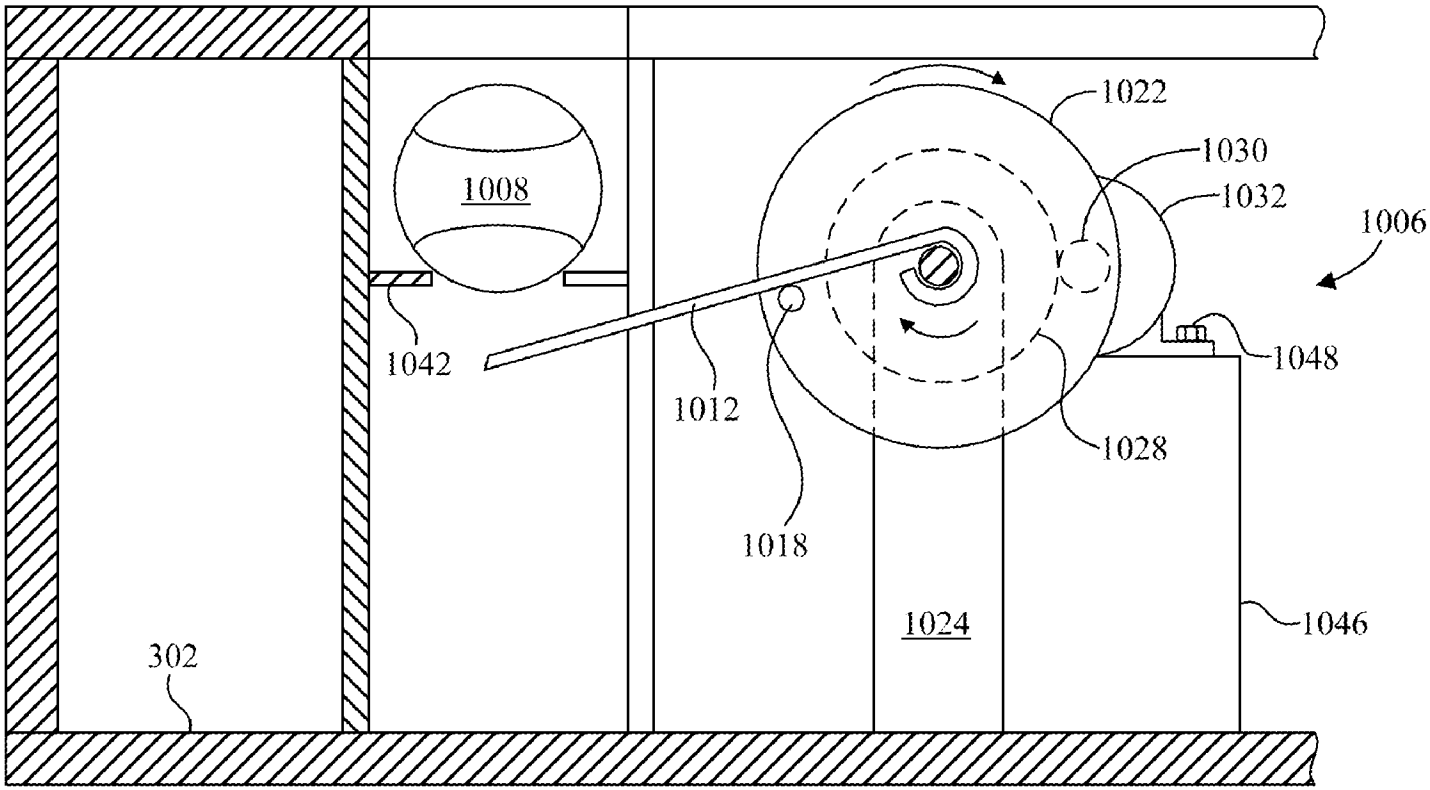
FIG. 12 is a cross-sectional view of the launch device of FIG. 10 taken along line C-C.

FIG. 12 shows another cross-sectional view of launch device 1006 taken along section line C-C of FIG. 10. In the present view, motor 1032 is shown retained above base 302 by a riser block 1046. Riser block 1046 elevates motor 1032 a distance sufficient such that motor gear 1030 can easily mesh with shaft gear 1028. Motor 1030 is coupled to riser block 1046 with a plurality of fasteners (e.g., screws) 1048, only one of which is shown in the present view. It should be noted that, although lever arm 1018 is shown in the present view, lever arm 1018 is not coupled to rotor 1022. Rather, lever arm 1018 is only coupled to first rotor 1014. Rotor 1022 merely serves as a position retainer to keep lever 1012 positioned near the center of shaft 1026.

Figure 13:
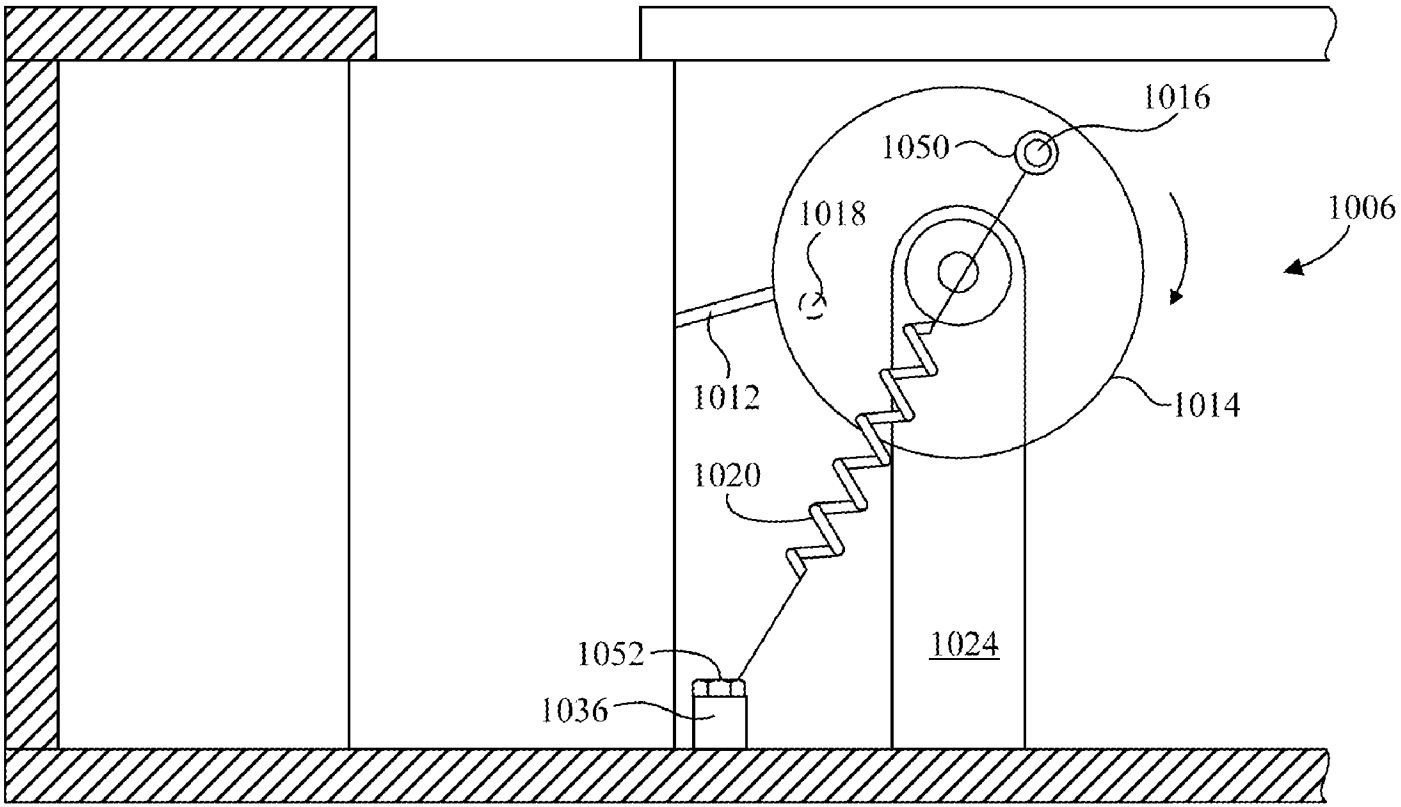
FIG. 13 is a side view of the launch device of FIG. 10.

FIG. 13 is a side view of launch device 1006 of FIG. 10, showing biasing member 1020 in greater detail. In the present view, biasing member 1020 is coupled to biasing member receiver 1016 via a loop 1050 and to fastening point 1036 via a fastener 1052 (e.g., a screw). Spring 1020 is disposed far enough away from mount 1024 and rotor 1014 so as not to get caught on a portion of either component as rotor 1014 rotates. Although spring 1020 is shown as a metal spring in the present example, other biasing members (e.g., a rubber band, etc.) can be used, depending on the force required for the particular application.

The description of particular embodiments of the present invention is now complete. Many of the described features may be substituted, altered or omitted without departing from the scope of the invention. For example, one embodiment of the present invention may be built into a permanent structure. As another example, alternate means for propelling baseballs 108(1-n) into the air, including but not limited to, compressed air, rubber bands, etc. may be substituted for coil springs 308(1-n). Further, other types of release mechanisms may be substituted for solenoids 314(1-n). As yet another example, alternate launch device layouts (e.g. outside the strike zone) can be used. These and other deviations from the particular embodiments shown will be apparent to those skilled in the art, particularly in view of the foregoing disclosure.

We claim:

1. A ball tossing apparatus, comprising:

a support frame;

a plurality of launch devices fixed to said support frame, said launch devices arranged in a two-dimensional array having at least two of said launch devices arranged along each dimension;

a user interface operative to receive input from a user;

a controller responsive to said input from said user and operative to generate a series of launch signal addresses, each of said launch signal addresses identifying one of said plurality of launch devices to be activated at its respective location in said two-dimensional array; and a decoder operative to decode each of said series of launch signal addresses and, for each of said launch signal addresses, to provide an electronic launch signal to the identified one of said plurality of launch devices; and wherein each of said launch devices is individually activated responsive to said electronic launch signals, thereby enabling the controlled sequential activation of said launch devices.

2. A ball tossing apparatus according to claim 1, wherein said launch devices are disposed to launch said balls substantially vertically.

3. A ball tossing apparatus according to claim 1, wherein said support frame includes a top deck defining openings through which said balls are projected.

4. A ball tossing apparatus according to claim 3, wherein said launch devices are disposed below said top deck at least when in a loaded position.

5. A ball tossing apparatus according to claim 3, wherein said support frame further includes a base and sides, said base and sides together with said top deck defining an interior of said support frame, at least a portion of which is adapted for ball storage.

6. A ball tossing apparatus according to claim 3, wherein said top deck is rectangular.

7. A ball tossing apparatus according to claim 1, further comprising a handle, coupled to said support frame, to facilitate transportation of said ball tossing apparatus.

8. A ball tossing apparatus according to claim 1, wherein said support frame is recessed in a floor of a permanent structure.

9. A ball tossing apparatus according to claim 1, wherein said support frame includes indicia of a baseball home plate.

10. A ball tossing apparatus according to claim 9, wherein the position of said indicia is adjustable.

11. A ball tossing apparatus according to claim 1, further including an electronic control system comprising:

a processing unit for executing data and code; and memory for storing data and code, said code including a launch module for sequentially activating said plurality of launch devices.

12. A ball tossing apparatus according to claim 11, further including a user interface for receiving input from a user.

13. A ball tossing apparatus according to claim 12, wherein said user interface comprises a keypad.

14. A ball tossing apparatus according to claim 12, wherein said user interface comprises a remote control, whereby said balls may be sequentially launched remotely.

15. A ball tossing apparatus according to claim 12, wherein said launch module, responsive to instructions from a user, is operative to execute one of a plurality of predetermined launch sequences.

16. A ball tossing apparatus according to claim 12, wherein said launch module, responsive to instructions from said user, is operative to receive and store a launch sequence input by said user.

17. A ball tossing apparatus according to claim 16, wherein said launch module, responsive to instructions from said user, is operative to execute said launch sequence input by said user.

18. A ball tossing apparatus according to claim 12, wherein said code further includes a random sequence generator operative to generate a random launch sequence.

19. A ball tossing apparatus according to claim 11, wherein said code further includes at least one predefined launch sequence.

20. A ball tossing apparatus according to claim 11, wherein said code further includes a random sequence generator for generating a random launch sequence.

21. A ball tossing apparatus according to claim 20, wherein:

said code further comprises at least one predefined launch sequence; and said control system further includes a user interface to enable a user to select between a predefined launch sequence and a random launch sequence.

22. A ball tossing apparatus according to claim 21, wherein said user interface further enables said user to input a launch sequence.

23. A ball tossing apparatus according to claim 11, wherein:

said control system further includes a user input device for receiving launch instructions from a user; and said launch module responsive to each received launch instruction is operative to activate a single one of said launch devices.

24. A ball tossing apparatus according to claim 23, wherein said launch module responsive to each subsequently received launch instruction is operative to activate a next one of said launch devices according to a predetermined launch sequence.

25. A ball tossing apparatus according to claim 23, wherein said launch module responsive to each subsequently received launch instruction is operative to activate a next one of said launch devices depending on a value of said subsequently received launch instruction.

26. A ball tossing apparatus according to claim 1, wherein the distance between at least two of said launch devices exceeds the width of a conventional strike zone.

27. A ball tossing apparatus according to claim 1, wherein said launch devices are arranged to cover an area in front of and behind a conventional home plate.

28. A ball tossing apparatus according to claim 1, wherein said launch devices are arranged with respect to one another such that when at least one of said launch devices is positioned in front of a conventional home plate, at least one other of said launch devices is positioned behind said conventional home plate.

29. A ball tossing apparatus according to claim 1, wherein:

the distance between at least two of said launch devices is greater than or equal to the width of a conventional strike zone in a first dimension of said two-dimensional array, and the distance between at least two of said launch devices exceeds the depth of a conventional home plate in a second dimension of said two-dimensional array.

30. A ball tossing apparatus according to claim 1, wherein at least one of said launch devices comprises:

a biasing member for projecting a ball from said launch device; and a release device for retaining said biasing member in a loaded position, and for releasing said biasing member to project said ball.

31. A ball tossing apparatus according to claim 30, wherein said biasing member comprises at least one spring.

32. A ball tossing apparatus according to claim 31, wherein said at least one launch device comprises a cylinder having a coil spring disposed therein.

33. A ball tossing apparatus according to claim 32, wherein said at least one launch device further comprises a carrier coupled to said coil spring.

34. A ball tossing apparatus according to claim 33, wherein each said carrier further includes at least one engaging structure adapted to engage said release device.

35. A ball tossing apparatus according to claim 34, wherein said carrier further includes a plurality of said engaging structures, thereby facilitating multiple loaded positions of said carrier.

36. A ball tossing apparatus according to claim 32, wherein said at least one launch device further includes a cup, having a conical interior surface, coupled to said coil spring for carrying balls of varying diameters.

37. A ball tossing apparatus according to claim 36, wherein said conical interior surface of said cup comprises a plurality of stepped rings.

38. A ball tossing apparatus according to claim 1, wherein at least one of said launch devices comprises:

a lever having a first end rotatably coupled to said support frame and a second end for contacting said ball; and a driving member mounted to contact said lever at a position intermediate said first and second ends to cause said lever to rotate and project said ball.

39. A ball tossing apparatus according to claim 38, wherein:

said launch device further includes a shaft and a rotor mounted to said shaft; and said driving member is mounted on said rotor.

40. A ball tossing apparatus according to claim 39, wherein said launch device further includes a biasing member coupled to said rotor to accelerate said rotor through a predefined angle of rotation.

41. A ball tossing apparatus according to claim 40, wherein said biasing member comprises a coil spring having a first end coupled to said rotor and a second end coupled to said support frame.

42. A ball tossing apparatus according to claim 40, wherein:

said rotor is fixed to said shaft such that said rotor can be driven by said shaft; and said first end of said lever is freely rotatable about said shaft.

43. A ball tossing apparatus according to claim 40, wherein said rotor is mounted to said shaft with a ratchet gear.

44. A ball tossing apparatus according to claim 40, wherein:

said biasing member is coupled to a first side of said rotor; and and said lever is positioned on an opposite side of said rotor.

45. A ball tossing apparatus according to claim 40, wherein:

said at least one launch device further comprises a ball receiving cylinder having a longitudinal portion removed therefrom; and wherein said lever passes through said longitudinal portion to contact said ball.

46. A ball tossing apparatus according to claim 45, wherein said ball receiving cylinder includes an interior lip disposed to support said ball in an elevated position.

47. A ball tossing apparatus according to claim 38, wherein said support frame includes a top deck having a slot formed therein such that said lever can pass through said slot when said lever is rotated about said first end.

48. A ball tossing apparatus according to claim 38, wherein said launch device includes a biasing member coupled to said driving member so as to urge said driving member into contact with said lever.

49. In a ball tossing apparatus, a method for sequentially launching a plurality of balls, said method comprising:

receiving said plurality of balls into a corresponding plurality of separate launch devices of said ball tossing apparatus, said launch devices being arranged in a two-dimensional array having at least two of said launch devices arranged along each dimension;

receiving input from a user;

generating a series of launch signal addresses, each of said launch signal addresses identifying one of said plurality of launch devices to be activated at its respective location in said two-dimensional array;

decoding each launch signal address of said series of launch signal addresses;

providing an electronic activation signal to the identified one of said plurality of launch devices for each of said decoded launch signal addresses; and launching said balls according to a launch sequence by sequentially providing said electronic activation signal to each of said launch devices.

50. A method for sequentially launching a plurality of balls according to claim 49, wherein said step of loading said plurality of balls includes loading each of said balls in one of a plurality of loaded positions, each of said loaded positions corresponding to a different launch height.

51. A method for sequentially launching a plurality of balls according to claim 49, wherein said step of launching said balls includes selecting said launch sequence.

52. A method for sequentially launching a plurality of balls according to claim 51, wherein said step of selecting said launch sequence includes receiving said launch sequence from a user.

53. A method for sequentially launching a plurality of balls according to claim 52, wherein said step of receiving said launch sequence from said user includes storing said launch sequence for later retrieval.

54. A method for sequentially launching a plurality of balls according to claim 52, wherein said step of selecting said launch sequence includes generating a random launch sequence.

55. A method for sequentially launching a plurality of balls according to claim 51, wherein said step of selecting said launch sequence includes retrieving a predefined launch sequence from a plurality of predefined launch sequences.

56. A method for sequentially launching a plurality of balls according to claim 55, wherein said step of retrieving a predefined launch sequence from memory includes retrieving a predefined launch sequence previously input by a user.

57. A method for sequentially launching a plurality of balls according to claim 49, wherein said step of launching said balls further includes, launching each of said balls upon receipt of a separate user input launch instruction.

58. A method for sequentially launching a plurality of balls according to claim 57, wherein said launch instructions are generated remotely.

59. A method according to claim 49, wherein said launch sequence is determined according to values of user input launch instructions received prior to the launch of each of said balls.

60. A computer-readable storage medium, having non-transitory computer-executable instructions stored thereon, which when executed by a ball tossing apparatus, cause the ball tossing apparatus to perform the method of claim 49.

61. A computer-readable storage medium, having non-transitory computer-executable instructions stored thereon, which when executed by a ball tossing apparatus, cause the ball tossing apparatus to perform the method of claim 50.

62. A computer-readable storage medium, having non-transitory computer-executable instructions stored thereon, which when executed by a ball tossing apparatus, cause the ball tossing apparatus to perform the method of claim 51.

63. A computer-readable storage medium, having non-transitory computer-executable instructions stored thereon, which when executed by a ball tossing apparatus, cause the ball tossing apparatus to perform the method of claim 52.

64. A computer-readable storage medium, having non-transitory computer-executable instructions stored thereon, which when executed by a ball tossing apparatus, cause the ball tossing apparatus to perform the method of claim 53.

65. A computer-readable storage medium, having non-transitory computer-executable instructions stored thereon, which when executed by a ball tossing apparatus, cause the ball tossing apparatus to perform the method of claim 54.

66. A computer-readable storage medium, having non-transitory computer-executable instructions stored thereon, which when executed by a ball tossing apparatus, cause the ball tossing apparatus to perform the method of claim 55.

67. A computer-readable storage medium, having non-transitory computer-executable instructions stored thereon, which when executed by a ball tossing apparatus, cause the ball tossing apparatus to perform the method of claim 56.

68. A computer-readable storage medium, having non-transitory computer-executable instructions stored thereon, which when executed by a ball tossing apparatus, cause the ball tossing apparatus to perform the method of claim 57.

69. A computer-readable storage medium, having non-transitory computer-executable instructions stored thereon, which when executed by a ball tossing apparatus, cause the ball tossing apparatus to perform the method of claim 58.

70. A computer-readable storage medium, having non-transitory computer-executable instructions stored thereon, which when executed by a ball tossing apparatus, cause the ball tossing apparatus to perform the method of claim 59.

71. A ball tossing apparatus comprising:

a plurality of electronically activated ball launch devices arranged in a two- dimensional pattern having at least two of said launch devices arranged along each dimension; and means for receiving input from a user;

means, responsive to said input from said user, for generating a series of launch signal addresses, each of said launch signal addresses identifying one of said plurality of launch devices to be activated at its respective location in said two-dimensional pattern; and means for decoding each of said series of launch signal addresses and for providing an electronic launch signal to the identified ones of said plurality of launch devices; and means for sequentially activating said launch devices.

* * * * *